United States Patent [19]

Eylon et al.

[11] Patent Number: 4,931,253

[45] Date of Patent: Jun. 5, 1990

[54] METHOD FOR PRODUCING ALPHA TITANIUM ALLOY PM ARTICLES

[75] Inventors: Daniel Eylon, Dayton; Francis H. Froes, Xenia; Gerhard Welsch, Cleveland Heights, all of Ohio

[73] Assignee: United States of America as represented by the Secretary of the Air Force, Washington, D.C.

[21] Appl. No.: 392,673

[22] Filed: Aug. 7, 1989

[51] Int. Cl.[5] ..... B22F 1/00

[52] U.S. Cl. ..... 419/25; 419/48; 419/49; 75/245

[58] Field of Search ..... 419/25, 48, 49; 75/245

[56] References Cited

U.S. PATENT DOCUMENTS

| | | | |
|---|---|---|---|
| 3,729,971 | 5/1973 | Gurganus et al. | 419/42 |
| 4,534,808 | 8/1985 | Eylon et al. | 148/133 |
| 4,536,234 | 8/1985 | Eylon et al. | 148/133 |
| 4,564,501 | 1/1986 | Goldstein | 419/25 |
| 4,714,587 | 2/1987 | Eylon et al. | 419/29 |
| 4,810,289 | 3/1989 | Hoyer et al. | 75/232 |

OTHER PUBLICATIONS

"Status of Titanium Powder Metallurgy", by Eylon et al., in Industrial Applications of Titanium and Zirconium: Third Conference, ASTM STP 830, 48-65 (1984).

"Developments in Titanium Powder Metallurgy", Froes et al., J. Metals 32:2, 47-54 (Feb. 1980).

"Powder Metallurgy of Light Metal Alloys for Demanding Applications", Froes et al., J. Metals 36:1, 14-28 (Jan. 1984).

"HIP Compaction of Titanium Alloy Powders at High Pressure and Low Temperature", Eylon et al. (Metal Powder Report 41:4 (Apr. 1986)).

*Primary Examiner*—Stephen J. Lechert, Jr.
*Assistant Examiner*—Leon Nigohosian, Jr.
*Attorney, Agent, or Firm*—Bobby D. Scearce; Donald J. Singer

[57] ABSTRACT

A method for producing a titanium alloy powder metallurgy article having high resistance to loading and creep at high temperature is described and comprises the steps of simultaneously pressing a preselected quantity of titanium alloy powder at from 15 to 60 ksi and heating the powder to a temperature just below the beta transus temperature of the alloy to promote beta to alpha phase transformation in the alloy, and then slowly cooling the compacted powder under pressure.

5 Claims, No Drawings

METHOD FOR PRODUCING ALPHA TITANIUM ALLOY PM ARTICLES

RIGHTS OF THE GOVERNMENT

The invention described herein may be manufactured and used by or for the Government of the United States for all Governmental purposes without the payment of any royalty.

BACKGROUND OF THE INVENTION

The present invention relates generally to methods for processing titanium alloys in the fabrication of powder metallurgy (PM) titanium alloy articles, and more particularly to a method for producing alpha phase titanium alloy PM articles with high resistance to loading and creep at elevated temperature.

Background information on the processing of titanium articles fabricated by PM techniques is fairly represented by or described in U.S. Pat. No. 4,534,808, U.S. Pat. No. 4,536,234 and U.S. Pat. No. 4,714,587, to Eylon et al, all assigned to the assignee hereof, and the publications, "Status of Titanium Powder Metallurgy", by Eylon et al (in *Industrial Applications of Titanium and Zirconium: Third Conference,* ASTM STP 830, pp 48–65 (1984)), "Developments in Titanium Powder Metallurgy", by Froes et al (J Metals 32: 2, 47–54 (Febuary 1980)), "Powder Metallurgy of Light Metal Alloys for Demanding Applications", by Froes et al (J Metals 36: 1, 14–28 (January 1984)), and "HIP Compaction of Titanium Alloy Powders at High Pressure and Low Temperature", by Eylon et al (Metal Powder Report 41: 4 (April 1986)). Teachings of these references and background material presented therein are incorporated herein by reference.

Titanium alloys are characterized by substantial room temperature strength resulting ordinarily from the presence of solid solution alloying elements such as aluminum, vanadium, zirconium and molybdenum, and from the presence in the alloys of one or both of the alpha and beta phases.

Titanium alloys composed primarily of the alpha phase have high temperature strength and resistance to creep significantly greater than that of alloys having appreciable beta phase content, because of higher temperature deformation resistance and limited slip systems of the hexagonal close packed (HCP) structure which characterizes the alpha phase. However, most elements used for solid solution strengthening, such as vanadium, molybdenum and zirconium, produce some beta phase at room and higher temperature. Presence of beta phase reduces resistance of the alloy to deformation (creep), particularly at high temperature, as a result of the body centered cubic (BCC) beta phase structure typically exhibiting numerous slip systems at high temperature. Alloys for use at high temperature are therefore formulated to include minimal beta phase and are known as alpha or near-alpha alloys. Reducing the beta phase content in an alloy conventionally requires concurrently reducing the content of desirable solid solution alloying elements. A desirable alloy would be one rich in strengthening alloying constituents but substantially free of beta phase.

The invention solves or substantially reduces in critical importance problems with existing PM techniques for fabricating titanium alloy articles by providing a method for producing alpha and alpha-rich titanium alloy PM articles with substantially improved resistance to loading at elevated temperature. According to the invention, application of very high pressure on titanium alloy powder containing alpha and beta phases, at a temperature slightly below the beta transus temperature of the alloy, followed by slow cooling of the powder, provides a powder compact of the alloy as a PM article virtually free of beta phase.

It is therefore a principal object of the invention to provide a method for processing titanium alloys in the fabrication of PM titanium alloy articles.

It is yet another object of the invention to provide a method for producing titanium alloy PM articles having improved high temperature deformation resistance.

These and other objects of the invention will become apparent as the detailed description of representative embodiments proceeds.

SUMMARY OF THE INVENTION

In accordance with the foregoing principles and objects of the invention, a method for producing a titanium alloy powder metallurgy article having high resistance to loading and creep at high temperature is described and comprises the steps of simultaneously pressing a preselected quantity of titanium alloy powder at from 15 to 60 ksi and heating the powder to a temperature just below the beta transus temperature of the alloy to promote beta to alpha phase transformation in the alloy, and then slowly cooling the compacted powder under pressure.

DETAILED DESCRIPTION

In accordance with the governing principle and inventive contribution of the invention, simultaneously pressing titanium alloy powder at high pressure and heating at selected temperature just below the beta transus temperature of the alloy, followed by controlled slow cooling under pressure to room temperature, results in a compacted article virtually free of the beta phase of the alloy. The method of the invention enhances beta-to-alpha phase transformation in the alloy powder, reduces total volume occupied by the alloy and increases the density of the powder compact. Hot isostatic pressing (HIP) of compacted articles of Ti-6Al-4V in the range of 15 to 60 ksi and 800° to 990° C. contained no beta phase. The beta transus temperature of Ti-6Al-4V is about 995° C. Although hot pressing titanium alloy powder containing both alpha and beta phases generally at 15–60 ksi substantially removed the beta phase, use of high pressure at or greater than 45 ksi proved to be most effective. The alloy must be heated to a temperature of about 5° to 200° C. below the beta transus temperature of the alloy for sufficient time (viz., 10 to 500 minutes), depending on the selected quantity of powder forming the article, in order to promote beta-to-alpha phase transformation. Slow cooling to room temperature under pressure at a rate of 200°–1000° F. per hour was satisfactory. Absence of beta phase and predominance of alpha phase in the compacted articles is attributed to the BCC beta phase being less densely packed than the HCP alpha phase, thus high pressure favors the closer packing HCP phase. The absence of beta phase in the compacted articles was shown by transmission electron microscopy; the same alloy heat treated similarly without pressure and slow cooling exhibited at least 5 volume percent beta phase at room temperature.

Other alpha, near-alpha and alpha-beta titanium alloys which may be used in fabricating articles according to the invention include Ti-0.8Ni-0.3Mo, Ti-5Al-2.5Sn, Ti-6Al-2Sn-4Zr-2Mo-0.1Si, Ti-8Al-1Mo-1V, Ti-6Al-2Nb-1Ta-0.8Mo, Ti-2.25Al-11Sn-5Zr-1Mo, Ti-5Al-5Sn-2Zr-2Mo, Ti-6Al-6V-2Sn, Ti-8Mn, Ti-4.5Al-5Mo-1.5Cr, Ti-6Al-2Sn-4Zr-6Mo, Ti-5Al-2Sn-2Zr- 4Mo-4Cr, Ti-6Al-2Sn-2Zr-2Mo-2Cr Ti-7Al-4Mo, and Ti-3Al-2.5V, alloy selection being clearly not limiting of the invention.

Alloy powder articles produced in demonstration of the invention were compacted using HIP, although other compaction methods may be used such as vacuum hot pressing or rapid omnidirectional compaction, the same not being limiting of the invention.

The invention therefore provides a method for producing alpha or near alpha titanium alloy PM articles having high resistance to loading and creep at high temperature. Titanium alloys containing beta stabilizing alloying elements such as vanadium, molybdenum and zirconium may be used, thus combining solid solution strengthening with high temperature deformation resistance. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

We claim:

1. A method for producing a titanium alloy powder metallurgy article having high resistance to loading and creep at high temperature, comprising the steps of:

(a) providing a preselected quantity of titanium alloy powder;

(b) simultaneously pressing said powder at a pressure in the range of from 15 to 60 ksi and heating said powder to a temperature just below the beta transus temperature of said alloy to promote beta to alpha phase transformation in said alloy; and (c) slowly cooling said powder under said pressure substantially to room temperature.

2. The method of claim 1 wherein pressing of said powder is performed at or greater than 45 ksi.

3. The method of claim 1 wherein the powder is cooled at a rate of not less than 200° F. per hour nor more than 1000° F. per hour.

4. The method of claim 1 wherein said powder is one of an alpha, near-alpha and alpha-beta titanium alloy.

5. The method of claim 4 wherein said powder is a titanium alloy selected from the group consisting of Ti-6Al-4V, Ti-0.8Ni-0.3Mo, Ti-5Al-2.5Sn, Ti-6Al-2Sn-4Zr-2Mo-0.1Si, Ti-8Al-1Mo-1V, Ti-6Al-2Nb-1Ta-0.8Mo, Ti-2.25Al-11Sn-5Zr-1Mo, Ti-5Al-5Sn-2Zr-2Mo, Ti-6Al-6V-2Sn, Ti-8Mn, Ti-4.5Al-5Mo-1.5Cr, Ti-6Al-2Sn-4Zr-6Mo, Ti-5Al-2Sn-2Zr-4Mo-4Cr, Ti-6Al-2Sn-2Zr-2Mo-2Cr Ti-7Al-4Mo, and Ti-3Al-2.5V.

* * * * *